US010680317B2

(12) United States Patent
Ohno et al.

(10) Patent No.: US 10,680,317 B2
(45) Date of Patent: Jun. 9, 2020

(54) VEHICLE ANTENNA DEVICE

(71) Applicant: YOKOWO CO., LTD., Kita-ku, Tokyo (JP)

(72) Inventors: Sadao Ohno, Tomioka (JP); Kengo Osawa, Tomioka (JP)

(73) Assignee: YOKOWO CO., LTD., Kita-ku, Tokyo (JP)

( * ) Notice: Subject to any disclaimer, the term of this patent is extended or adjusted under 35 U.S.C. 154(b) by 0 days.

(21) Appl. No.: 16/428,491

(22) Filed: May 31, 2019

(65) Prior Publication Data

US 2019/0288380 A1 Sep. 19, 2019

Related U.S. Application Data

(62) Division of application No. 15/326,093, filed as application No. PCT/JP2015/061236 on Apr. 10, 2015, now Pat. No. 10,431,880.

(30) Foreign Application Priority Data

Jul. 18, 2014 (JP) ..... 2014-148300

(51) Int. Cl.
*H01Q 1/32* (2006.01)
*H01Q 9/14* (2006.01)
(Continued)

(52) U.S. Cl.
CPC ..... *H01Q 1/3275* (2013.01); *H01Q 1/32* (2013.01); *H01Q 7/00* (2013.01); *H01Q 9/14* (2013.01); *H01Q 9/36* (2013.01); *H01Q 7/02* (2013.01)

(58) Field of Classification Search
None
See application file for complete search history.

(56) References Cited

U.S. PATENT DOCUMENTS 2,898,563 A * 8/1959 De Cola ..... H03J 5/00 334/50
3,083,339 A * 3/1963 Bell ..... H03J 5/00 29/857
(Continued)

FOREIGN PATENT DOCUMENTS

EP 2040335 A1 3/2009
JP UM-S56-137509 A 10/1981
(Continued)

OTHER PUBLICATIONS

Extended European Search Report dated Jan. 26, 2018 in the corresponding European Patent Application No. 15822511.0.
(Continued)

*Primary Examiner* — Trinh V Dinh
(74) *Attorney, Agent, or Firm* — Morgan, Lewis & Bockius LLP

(57) ABSTRACT

A vehicle antenna device has a stably held coil element while its winding shape is maintained, and the number of turns of the coil element winding is easily adjusted during production. A coil element is configured by forming a winding around a resin-made bobbin. A guide groove, which is a path of the winding, and a plurality of projections, which are along the path of the winding, are disposed on the outer circumferential surface of the winding barrel of the bobbin. The guide groove spirally extends around the outer circumferential surface of the winding barrel. The projections are disposed in plural numbers in each of a plurality of circumferential positions on the outer circumferential surface of the winding barrel. A winding end portion of the winding is drawn out in the axial direction while being hooked to an arbitrary one of the projections, and electrically connected to an upper terminal.

12 Claims, 8 Drawing Sheets

(51) Int. Cl.

| | |
|---|---|
| ***H01Q 9/36*** | (2006.01) |
| ***H01Q 7/00*** | (2006.01) |
| *H01Q 7/02* | (2006.01) |

(56) References Cited

U.S. PATENT DOCUMENTS 4,080,604 A * 3/1978 Wosniewski ..... H01Q 9/14 343/745
4,086,596 A * 4/1978 Gauss ..... H01Q 9/30 343/715
4,882,591 A * 11/1989 Galvin ..... H01Q 1/1214 343/715
5,673,018 A * 9/1997 Lowe ..... B60C 23/0408 235/384
6,198,440 B1 * 3/2001 Ha ..... H01Q 1/244 343/702
6,400,327 B1 * 6/2002 Galvin ..... H01Q 1/36 343/715
7,427,963 B2 * 9/2008 Moriya ..... H01Q 7/08 343/713
7,733,283 B2 * 6/2010 Sato ..... H01Q 7/00 343/713
7,920,041 B2 * 4/2011 Rokuka ..... H01Q 1/1278 336/192
8,471,562 B2 * 6/2013 Knizhnik ..... G01V 3/18 324/333
10,431,880 B2 10/2019 Ohno et al.
2007/0164867 A1 * 7/2007 Kawai ..... G06K 19/07718 340/572.7
2009/0029646 A1 * 1/2009 Kristiansen ..... H04R 25/554 455/41.2
2011/0012776 A1 * 1/2011 Barrick ..... H01Q 7/00 342/175
2012/0080957 A1 * 4/2012 Cooper ..... H02J 5/005 307/104
2014/0125549 A1 5/2014 Kaneko
2014/0125550 A1 5/2014 Kaneko
2014/0159964 A1 6/2014 Kaneko
2014/0191921 A1 * 7/2014 Yang ..... H01Q 1/27 343/872
2014/0210487 A1 * 7/2014 Ohara ..... H01Q 1/3283 324/629
2014/0361949 A1 * 12/2014 Mahara ..... H01Q 7/00 343/866
2015/0194723 A1 * 7/2015 Yoshida ..... H01Q 1/084 343/720
2015/0200446 A1 7/2015 Kaneko
2015/0214607 A1 * 7/2015 Lee ..... H01Q 9/34 343/713
2015/0332071 A1 * 11/2015 Hoffa ..... B23K 5/00 340/10.2
2015/0356397 A1 * 12/2015 Boiron ..... G06K 19/07756 235/492
2017/0214112 A1 * 7/2017 Ohno ..... H01Q 1/1207

FOREIGN PATENT DOCUMENTS

JP 2012-204996 A 10/2012
JP 2013-229813 A 11/2013

OTHER PUBLICATIONS

International Search Report dated Jun. 9, 2015, for International application No. PCT/JP2015/061236.
Office Action dated Dec. 30, 2019 in corresponding U.S. Appl. No. 16/548,243.
Claims 1-15 filed in U.S. Appl. No. 16/428,491 (present application), six (6) pages.

* cited by examiner

VEHICLE ANTENNA DEVICE

TECHNICAL FIELD

The present invention relates to a vehicle antenna device which is to be mounted, for example, on a roof of a vehicle.

BACKGROUND ART

Recently, an antenna which is called a shark fin antenna has been developed. As an AM/FM antenna element, a combination of an umbrella-shaped capacitive element and a coil element is widely used. In a coil element, when a winding pitch and a diameter are increased, it is possible to obtain a higher antenna gain.

CITATION LIST

Patent Literature

Patent Literature 1: JP-A-2012-204996
Patent Literature 2: JP-A-2013-229813

SUMMARY OF INVENTION

Technical Problem

In Patent Literature 1, an air-core coil is used as a coil element. In an air-core coil, when a winding pitch and a diameter are increased, it is difficult to stably hold the coil while maintaining the winding shape. In Patent Literature 2, a coil element in which a winding is integrally molded with a resin-made element holder is used. In this case, although the coil element can be stably held while its winding shape is maintained, it is difficult to adjust the number of turns of the winding during a production process in order to meet a requirement for, for example, different frequencies due to different destination countries.

The present invention has been conducted in view of such circumstances. It is an object of the invention to provide a vehicle antenna device in which a coil element can be stably held while its winding shape is maintained, and the number of turns of the winding of the coil element can be easily adjusted during a production process.

Solution to Problem

An aspect of the present invention is a vehicle antenna device. The vehicle antenna device includes:

an antenna base;

an antenna case which is overlaid on the antenna base; and an antenna element and an amplifier board which are disposed inside the antenna case, the antenna element has a capacitive element and a coil element, the coil element is configured by forming a winding around a bobbin, a first terminal is disposed on a side of one end of the bobbin, the first terminal being electrically connected to one end of the coil element, and electrically connected to the capacitive element, a second terminal is disposed on a side of the other end of the bobbin, the second terminal being electrically connected to the other end of the coil element, and electrically connected to the amplifier board, a plurality of projections are disposed on an outer circumferential surface of the bobbin, and along a winding path of the coil element, and an end portion of the coil element is drawn out in an axial direction while being hooked on one of the plurality of projections.

One or more of the plurality of projections may be disposed in each of a plurality of circumferential positions.

In the first or second terminal, a mode of attachment to the bobbin is changeable, and one coil connecting portion may be selectively locatable in the plurality of circumferential positions.

The first or second terminal may have a plurality of coil connecting portions which correspond to the plurality of circumferential positions, respectively.

Arbitrary combinations of the above-described components, and expressions of the present invention which are converted in method and system are also effective as aspects of the present invention.

Advantageous Effects of Invention

According to the present invention, it is possible to provide a vehicle antenna device in which a coil element can be stably held while its winding shape is maintained, and the number of turns of the winding of the coil element can be easily adjusted during a production process.

DESCRIPTION OF EMBODIMENTS

Figure 1A:
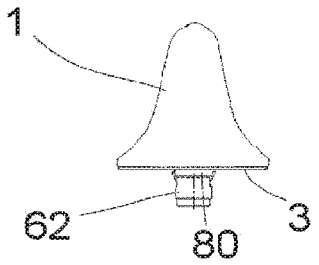
FIGS. 1(A), 1(B) and 1(C) are external views of a vehicle antenna device of Embodiment 1 according to the present invention.

Hereinafter, preferred embodiments of the present invention will be described in detail with reference to the drawings. Identical or equivalent components, members, and the like shown in the drawings are denoted by the same reference numerals, and duplicated descriptions are appropriately omitted. The embodiments do not limit the invention, but only exemplifies the invention, and all features described in the embodiments, and their combinations are not necessarily essential in the invention.

Embodiment 1

Figure 1B:
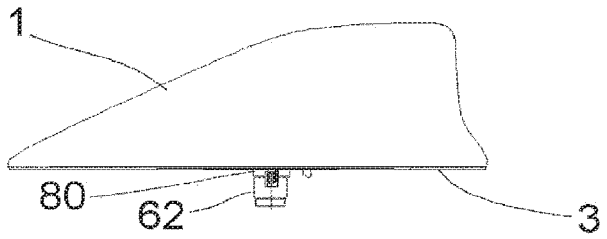
Figure 1C:
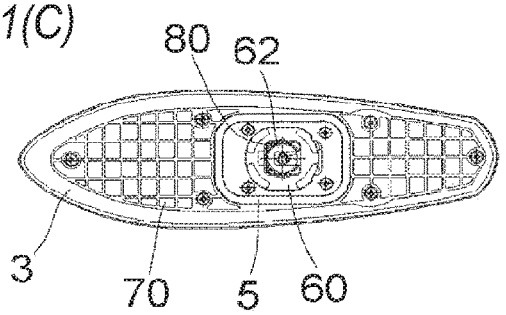
Figure 2:
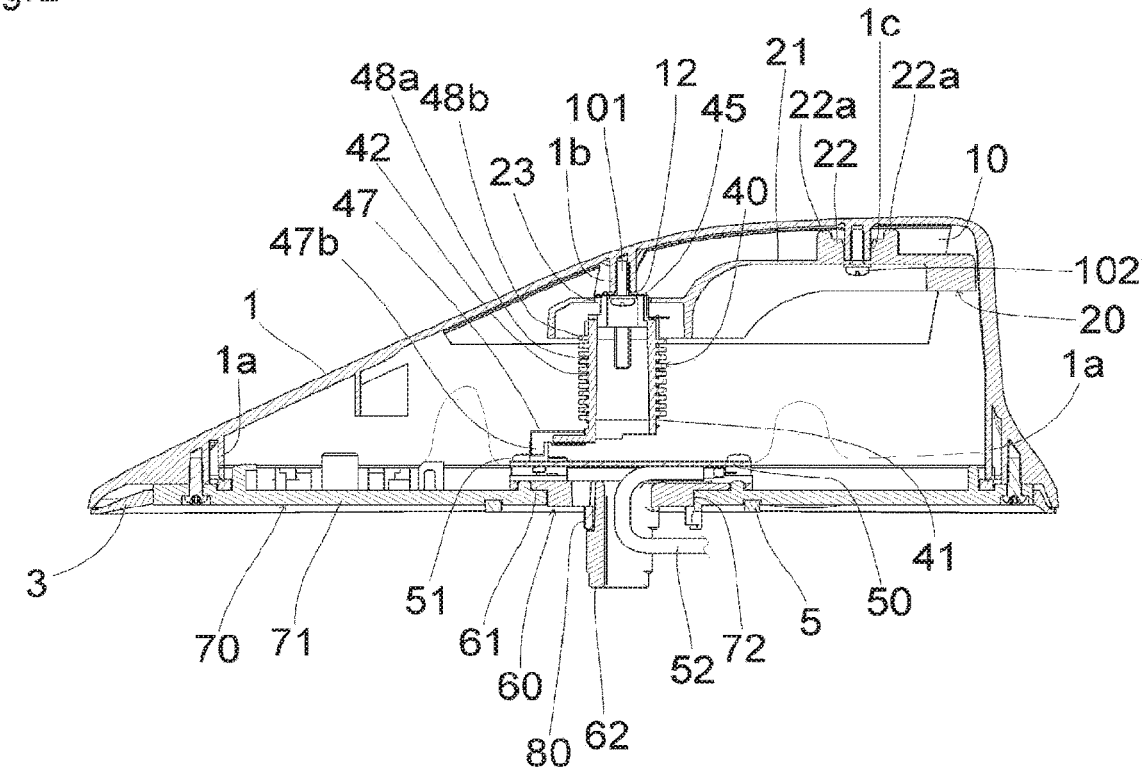
FIG. 2 is a side sectional view of the vehicle antenna device.
Figure 3:
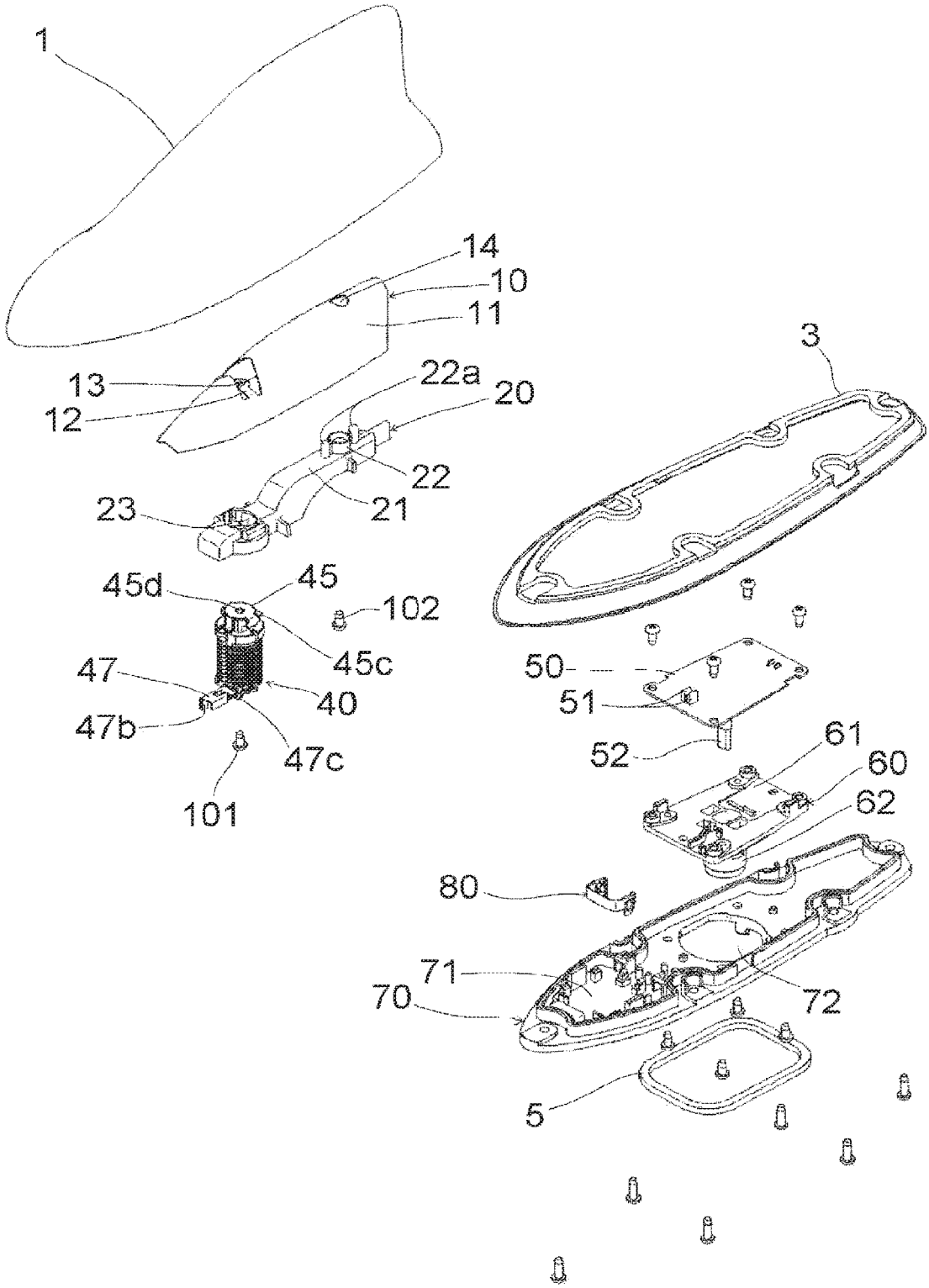
FIG. 3 is an exploded perspective view of the vehicle antenna device.

FIG. 1(A) is a front view of a vehicle antenna device of Embodiment 1 according to the present invention. FIG. 1(B) is a side view of the device, and FIG. 1(C) is a bottom view of the device. FIG. 2 is a side sectional view of the vehicle antenna device. FIG. 3 is an exploded perspective view of the vehicle antenna device.

An antenna case 1 is made of a radio wave transmissive synthetic resin (a molded product made of a resin such as PC or PET), and formed into a shark fin shape in which the side surfaces are inwardly curved. An antenna base is configured by combining a metal-made base 60 with a resin-made base 70. The resin-made base 70 has a through hole 72 (FIG. 3) in a middle portion of a planar portion 71. The metal-made base 60 is smaller in area than the resin-made base 70, and attached (fixed) by screwing or the like onto the planar portion 71 of the resin-made base 70 so as to close the through hole 72 of the resin-made base 70. The metal-made base 60 has: a planar portion 61 which is to cover the through hole 72; and a feeding cylindrical portion (hollow threaded shaft portion) 62 which is downwardly projected from the planar portion 61, and in which a male thread for attachment to the vehicle body (for example, the roof that is the panel to which attachment is to be made) is formed on the outer circumference. The feeding cylindrical portion 62 elongates below the resin-made base 70. An amplifier board 50 is attached (fixed) by screwing or the like onto the planar portion 61. A pair of conductor plate springs (terminals) 51 are disposed on the amplifier board 50. An output cable 52 downwardly elongates from the amplifier board 50, and passes through the inside of the feeding cylindrical portion 62 so as to be drawn out to the outside. An annular sealing member 5 is disposed between the planar portion 71 of the resin-made base 70 and the vehicle body. The sealing member 5 is disposed in the periphery of the through hole 72 of the resin-made base 70, and sandwiched and pressed between the planar portion 71 of the resin-made base 70 and the vehicle body, thereby preventing water from penetrating through a gap between the resin-made base 70 and the vehicle body.

A pad 3 is an elastic member made of elastomer, rubber, or the like, and is disposed on the resin-made base 70 so as to make a circle along the periphery of the resin-made base 70 or the vicinity thereof. The pad 3 functions as a screen for the gap between the the lower end edge of the antenna case 1 and the vehicle body, and has also a simple waterproof function between the resin-made base 70 and the vehicle body (the waterproof function is mainly exerted by the sealing member 5). The antenna case 1 is overlaid from the upper side on the resin-made base 70 while interposing the pad 3 therebetween, and attached (fixed) by screwing or the like to the resin-made base 70. The antenna case 1 has a rib 1*a* (FIG. 2) for pressing the pad 3 against the whole circumference of the resin-made base 70. Therefore, penetration of water through a gap between the antenna case 1 and the resin-made base 70 can be avoided. Threaded-hole equipped bosses 1*b*, 1*c* are disposed on the ceiling portion of the antenna case 1. A capacitive element 10 and a coil element 40 which serve as antenna elements are disposed in a space between the antenna case 1 and the antenna base (the metal-made base 60 and the resin-made base 70).

The capacitive element 10 is configured by a metal plate (conductor plate), and bent in, for example, a squeezing process so as to have an umbrella-shaped curved surface portion 11 which is approximately parallel to an arcuate ceiling surface that is in the upper portion of the inside of the antenna case 1. In a state where the capacitive element 10 is fixed to the antenna case 1, the curved surface portion 11 is in proximity to the ceiling surface of the antenna case 1. A connecting portion 12 which is concave toward the center of curvature of the curved surface portion 11 is disposed on the curved surface portion 11. The connecting portion 12 has a through hole 13 (FIG. 3). In the upper surface of the connecting portion 12, the periphery of the through hole 13 butts against the end surface of the threaded-hole equipped boss 1*b* (FIG. 2) in the antenna case 1. In the lower surface of the connecting portion 12, the periphery of the through hole 13 is a portion contacting with an upper terminal 45 of the coil element 40 which will be described later. In the curved surface portion 11, a through hole 14 (FIG. 3) is disposed in the rear of the connecting portion 12. The threaded-hole equipped boss 1*c* (FIG. 2) of the antenna case 1 is passed through the inside of the through hole 14.

An element holder 20 has a base portion 21, a cylindrical portion 22, and a through hole 23. The cylindrical portion 22 is raised from the base portion 21. The threaded-hole equipped boss 1*c* of the antenna case 1 is fitted into the inside of the cylindrical portion (FIG. 2). The element holder 20 is attached (fixed) to the antenna case 1 while interposing the capacitive element 10 therebetween, by a screw 102 which is screwed with the threaded-hole equipped boss 1*c*. Projections 22*a* are disposed in the front and rear of the cylindrical portion 22, respectively. The projections 22*a* press the capacitive element 10 against the ceiling surface of the antenna case 1. The through hole 23 disposed in the base portion 21, locates in the front of the cylindrical portion 22. The element holder 20 has a space in which an upper portion of a bobbin 41 of the coil element 40 that will be described later is located and supported (fitted), below the through hole 23.

The coil element 40 is configured by winding a winding 42 around the bobbin 41 which is made of a resin. The upper terminal 45 which is the first terminal is disposed (for example, pressingly inserted and fixed) in one end (upper end) of the bobbin 41. One end of the winding 42 is electrically connected to the upper terminal 45. A lower terminal 47 which is the second terminal is disposed (for example, pressingly inserted and fixed) in the other end (lower end) of the bobbin 41. The other end of the winding 42 is electrically connected to the lower terminal 47. The upper terminal 45 is attached (fixed) to the threaded-hole equipped boss 1*b* of the antenna case 1 while interposing the connecting portion 12 of the capacitive element 10 therebetween, by a screw 101. Namely, the screw 101 passes through a through hole 45*d* of the upper terminal 45, and the through hole 13 of the connecting portion 12 of the capacitive element 10, and screwed to the threaded-hole equipped boss 1*b* of the antenna case 1. Therefore, the coil element 40 and the capacitive element 10 butt against each other to be electrically connected to each other. Preferably, the screw 101 may have a spring washer so as to avoid a connection failure due to its loosening. A connection leg 47*b* of the lower terminal 47 is clamped by a pair of conductor plate springs 51 of the amplifier board 50. Therefore, the coil element 40 and the amplifier board 50 are electrically connected to each other.

Figure 4:
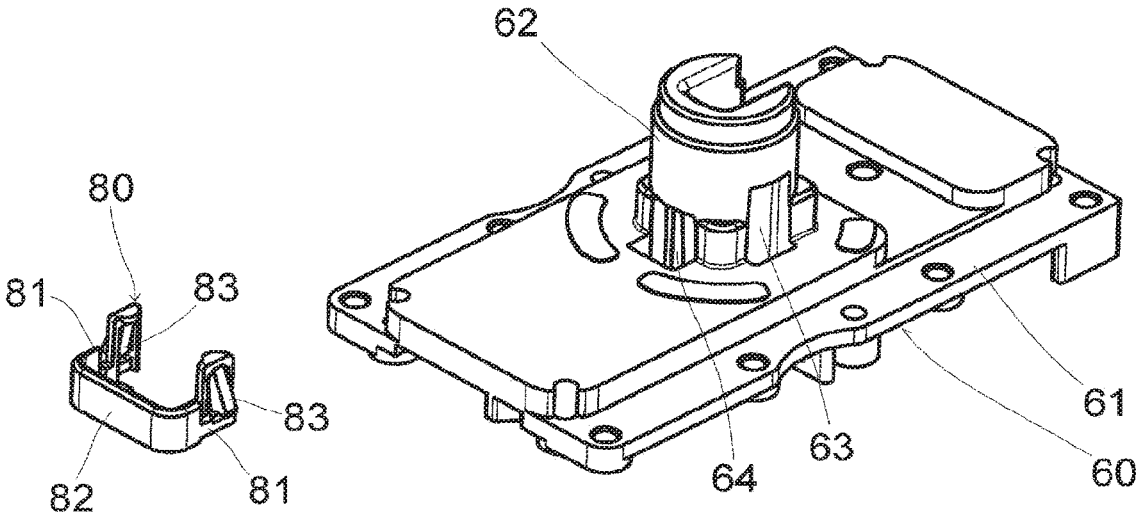
FIG. 4 is a perspective view of a disassembled state of a metal-made base 60 and a provisional fixing holder 80 of the vehicle antenna device.
Figure 5:
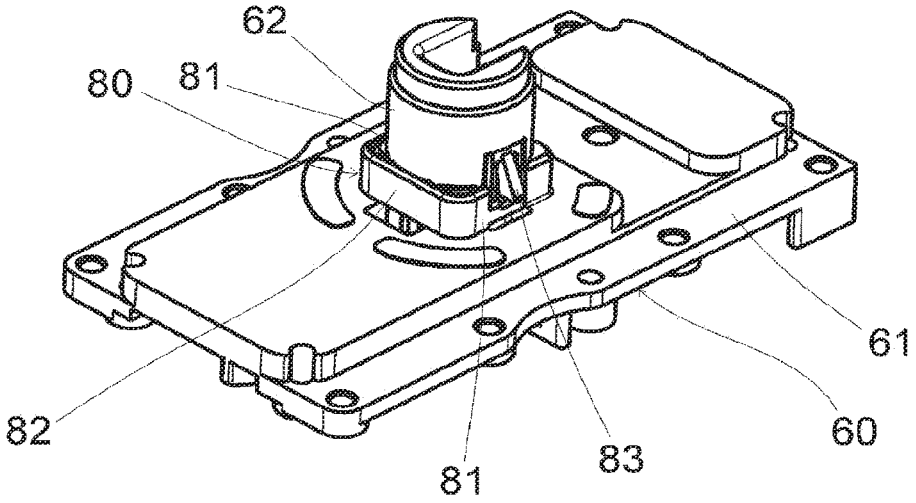
FIG. 5 is a perspective view of an assembled state of the metal-made base 60 and the provisional fixing holder 80 in FIG. 4.

FIG. 4 is a perspective view of a disassembled state of the metal-made base 60 and the provisional fixing holder 80 of the vehicle antenna device. FIG. 5 is a perspective view of an assembled state of the metal-made base 60 and the provisional fixing holder 80 in FIG. 4. The provisional fixing holder 80 has a U- or C-shaped external shape, and is engageable with (fittable into) the side surface of the feeding cylindrical portion 62 in a lateral direction perpendicular to the axial direction thereof. The provisional fixing holder 80 is engaged with the vehicle body roof that is the panel to which attachment is to be made, in a state where the feeding cylindrical portion is inserted from the outside into a through hole of the vehicle body roof, thereby provisionally fixing the antenna device to the vehicle body roof. The provisional fixing holder 80 is made of, for example, a flexible resin, and has: a pair of clamping portions 81 which clamp the feeding cylindrical portion 62; a liaison portion 82 through which the clamping portions 81 are connected to each other; and engaging claws 83 which are formed in tip end portions of the clamping portions 81, respectively, so as to be outwardly projected. The feeding cylindrical portion 62 has on the side surface a pair of first groove portions 63 (only one groove portion is shown in FIG. 4) which are to be engaged with the provisional fixing holder 80, and one second groove portion 64 which is at the midpoint between the first groove portions 63. The provisional fixing holder 80 is engaged with the first groove portions 63 and the second groove portion 64 to be attached to the feeding cylindrical portion 62. Namely, the pair of clamping portions 81 are engaged with the pair of first groove portions 63 so as to sandwich the feeding cylindrical portion 62, and the liaison portion 82 is engaged with the second groove portion 64. In the state where the feeding cylindrical portion 62 to which the provisional fixing holder 80 is attached is inserted into the through hole of the roof, then, the engaging claws 83 are caught by the inner surface of the roof, and can exert the provisionally fixing function.

Figure 6:
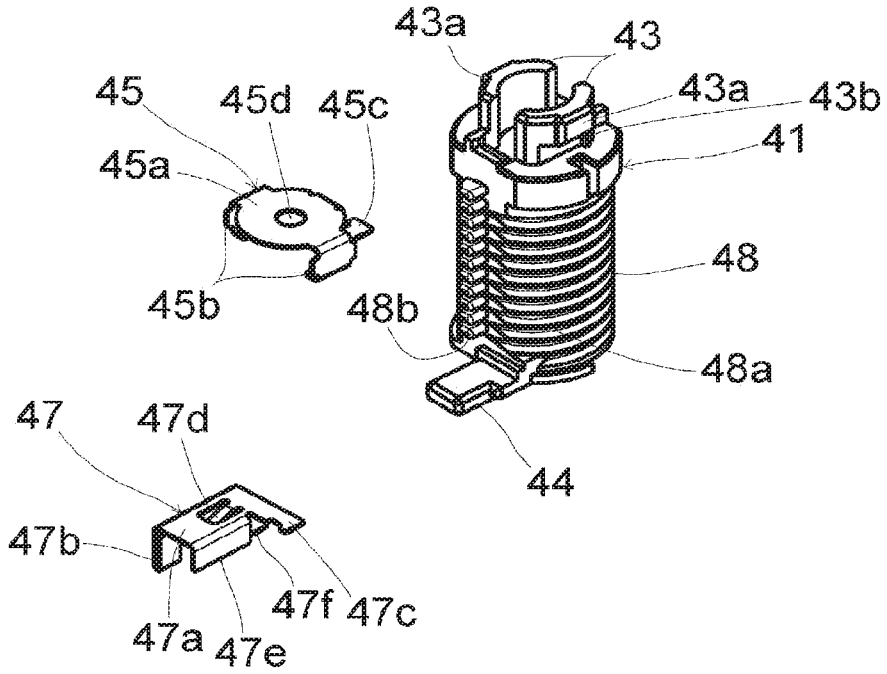
FIG. 6 is a perspective view of a disassembled state of a bobbin 41, an upper terminal 45, and a lower terminal 47 of a coil element 40 of the vehicle antenna device.
Figure 7:
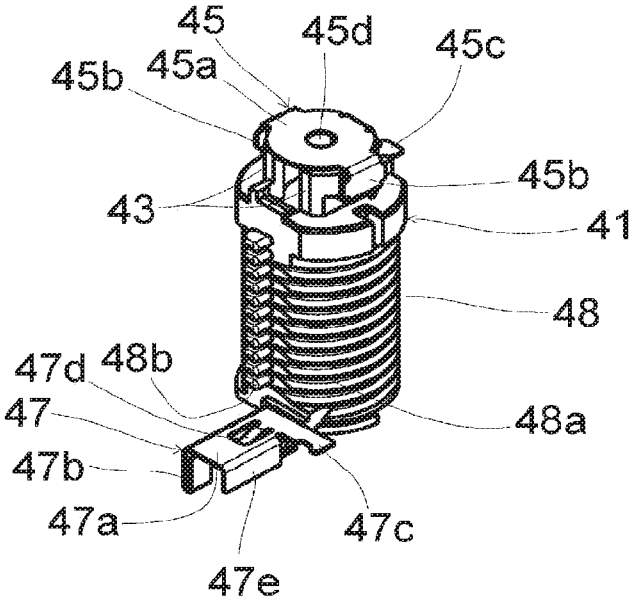
FIG. 7 is a perspective view of an assembled state of the bobbin 41, the upper terminal 45, and the lower terminal 47 in FIG. 6.

FIG. 6 is a perspective view of a disassembled state of the bobbin 41, the upper terminal 45, and the lower terminal 47 of the coil element 40. FIG. 7 is a perspective view of an assembled state of the bobbin 41, the upper terminal 45, and the lower terminal 47 in FIG. 6. FIGS. 8(A) to 8(H) are views illustrating steps of producing the coil element 40.

The upper terminal 45 has a base portion 45*a*, a pair of attaching legs 45*b*, and a winding terminal connecting portion (tab) 45*c*. A through hole 45*d* is disposed in a middle portion of the base portion 45*a*. The pair of attaching legs 45*b* are bent into a U-like shape with respect to the base portion 45*a*, and located in the opposite sides across the center of the base portion 45*a*, respectively. The winding terminal connecting portion 45*c* is bent into an L-like shape with respect to the base portion 45*a*, and located in a position which is different by 90 degrees from the attaching legs 45*b* about the through hole 45*d*.

The lower terminal 47 has an upper surface portion 47*a*, a connection leg 47*b*, a winding terminal connecting portion (tab) 47*c*, side surface portions 47*e*, and a lower surface portion 47*f* A plate spring portion 47*d* which is bent in an obliquely downward direction is disposed in a middle portion of the upper surface portion 47*a*. The plate spring portion 47*d* has a function of preventing the bobbin 41 from rattling with respect to a lower terminal attaching portion 44. The connection leg 47*b* is downwardly bent with respect to the upper surface portion 47*a*. The winding terminal connecting portion 47*c* extends from the upper surface portion 47*a* to be projected toward the outside. The side surface portions 47*e* are downwardly bent with respect to the upper surface portion 47*a* at the both ends of the upper surface portion 47*a*, respectively. The lower surface portion 47*f* is a portion which is formed by bending the lower end of one of the side surface portions 47*e*, and extending the lower end approximately in parallel to the upper surface portion 47*a*. The lower terminal 47 is attached to the lower terminal attaching portion 44 in such a manner that the lower terminal attaching portion 44 is surrounded by the upper surface portion 47*a*, the side surface portions 47*e*, and the lower surface portion 47*f*

Figure 9:
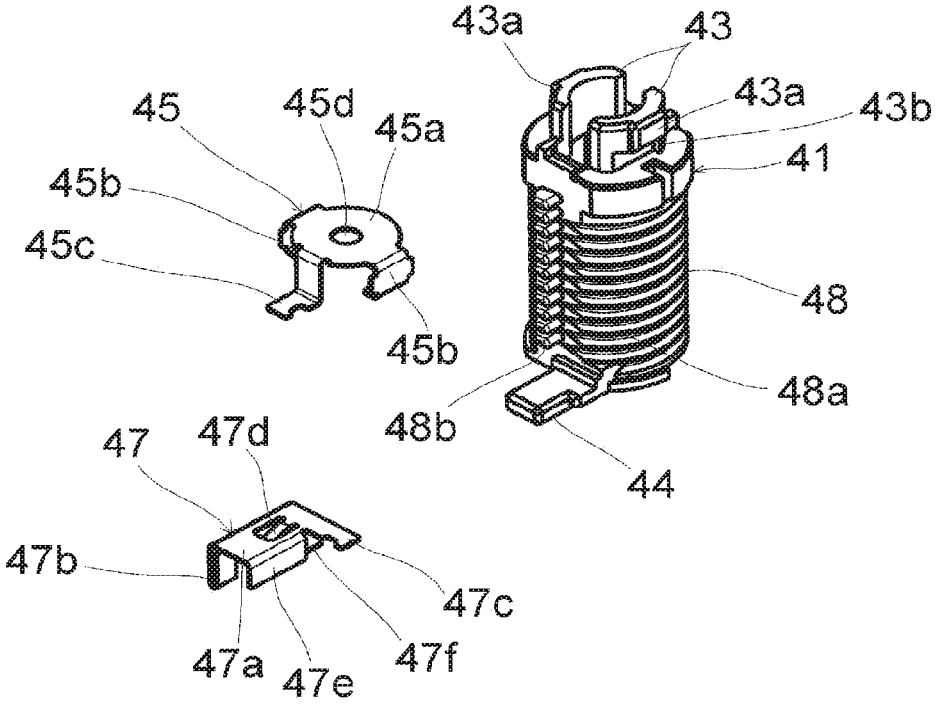
FIG. 9 is a perspective view of a disassembled state of the bobbin 41, the upper terminal 45, and the lower terminal 47 in the case where the upper terminal 45 is inverted by 180 degrees as compared with FIG. 6.

The bobbin 41 has: upper terminal attaching portions 43 to which the upper terminal 45 is to be attached; a lower terminal attaching portion 44 to which the lower terminal 47 is to be attached; and a cylindrical winding barrel 48 in which the winding 42 is wound on the outer circumferential surface. The upper terminal attaching portions 43 are erected on the upper end surface of the winding barrel 48 while being distributed on the both sides of the center axis of the winding barrel 48. The upper terminal attaching portions 43 have a pair of convex portions 43*a* which are outwardly projected in the opposite directions, respectively. The pair of U-shaped attaching legs 45*b* of the upper terminal 45 are engaged with the pair of convex portions 43*a*, respectively. The upper terminal 45 and the upper terminal attaching portions 43 are configured so that the upper terminal 45 is attached to the upper terminal attaching portions 43 by changing the attaching position by 180 degrees in the circumferential direction. Namely, the projecting circumferential position of the winding terminal connecting portion 45*c* of the upper terminal 45 can be changed to a first circumferential position which, as shown in FIG. 7, is opposite to the projection direction of the winding terminal connecting portion 47*c* of the lower terminal 47, or a second circumferential position which, as shown in FIG. 9, is in the same direction as the projection direction of the winding terminal connecting portion 47*c* of the lower terminal 47. The upper terminal 45 can be attached to the first circumferential position in the following manner. As shown in FIG. 6, the upper terminal 45 is placed so that the winding terminal connecting portion 45*c* is directed to the gap between the pair of convex portions 43*a* of the upper terminal attaching portions 43, and then skid toward the upper terminal attaching portions 43 to cause the pair of attaching legs 45*b* of the upper terminal 45 to be engaged with the pair of convex portions 43*a* of the upper terminal attaching portions 43 while passing the winding terminal connecting portion 45*c* through the gap between the pair of convex portions 43*a*. Then, moving-direction end portions of the pair of attaching legs 45*b* of the upper terminal 45 butt against stoppers 43*b* which are below the pair of convex portions 43*a* of the upper terminal attaching portions 43, to stop the sliding operation, and the attachment of the upper terminal 45 to the upper terminal attaching portions 43 is completed (FIG. 7). The lower terminal attaching portion 44 is disposed so as to protrude toward the outside in the lower end portion of the winding barrel 48. A guide groove 48*a* which is the winding path of the winding 42, and a plurality of projections 48*b* which are in positions along the winding path of the winding 42 are disposed on the outer circumferential surface of the winding barrel 48. The guide groove 48*a* spirally extends around the outer circumferential surface of the winding barrel 48, and is formed at intervals so that the wound winding 42 does not contact at least with each other, and that a predetermined pitch is ensured. The projections 48*b* are disposed in a plurality of circumferential positions on the outer circumferential surface of the winding barrel 48, in the illustrated example, in two circumferential positions which are separated from each other by 180 degrees. The two circumferential positions coincide with two circumferential positions where the winding terminal connecting portion 45*c* exists when the upper terminal 45 is attached to the bobbin 41 in two different circumferential positions. Moreover, the projections 48*b* are disposed in two circumferential positions of the outer circumferential surface of the winding barrel 48, in plural numbers (ten in one of the positions, and eleven in the other position) in the axial direction. Each of the projections 48*b* functions as a hooking portion in the case where the winding end portion of the winding 42 is drawn out in the axial direction. From the viewpoint of ensuring of strength, the projections 48*b* are formed into a planer shape having a flat surface which extends in the circumferential direction.

Figure 8A:
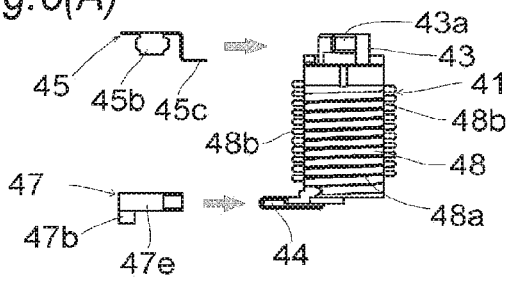
FIGS. 8(A) to 8(H) are views illustrating steps of producing the coil element 40.
Figure 8B:
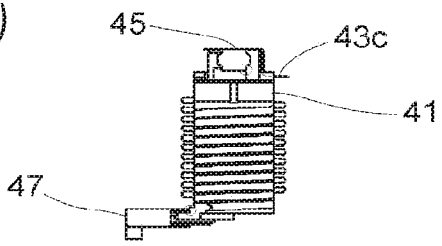
Figure 8C:
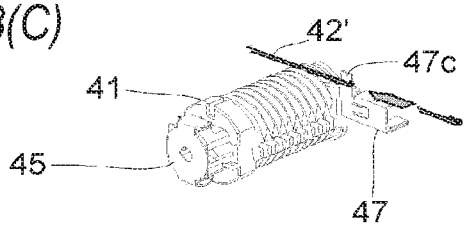
Figure 8D:
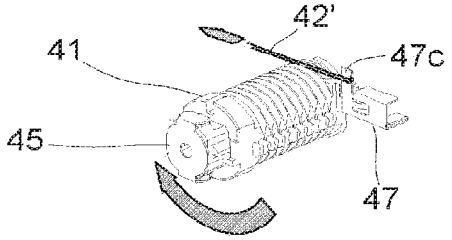
Figure 8E:
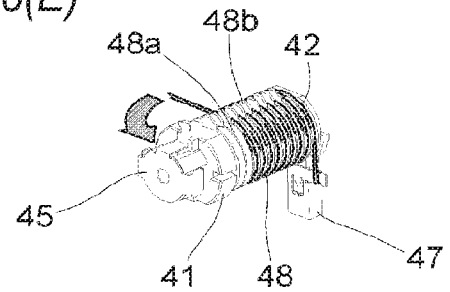
Figure 8F:
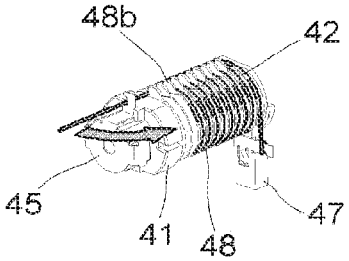
Figure 8G:
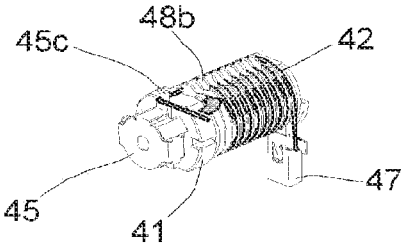
Figure 8H:
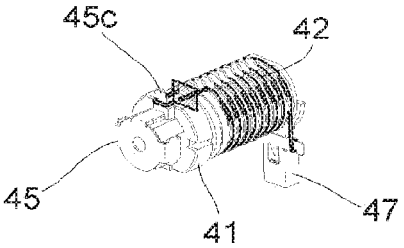

Steps of producing the coil element 40 will be described. As shown in FIGS. 8(A) and 8(B), first, the upper terminal 45 and the lower terminal 47 are slidingly attached to the upper terminal attaching portions 43 and the lower terminal attaching portion 44 of the bobbin 41, respectively. As shown in FIG. 8(C), then, a bent end portion of a wire 42' which is to be configured as the winding 42 is hooked to the winding terminal connecting portion 47*c* of the lower terminal 47, and connected and fixed thereto by soldering, welding, or the like. As shown in FIGS. 8(D) and 8(E), then, the winding 42 is wound around the outer circumferential surface (guide groove 48*a*) of the winding barrel 48 of the bobbin 41, while rotating the bobbin 41. The winding pitch of the winding 42 is determined by the arrangement pitch of the guide groove 48*a*. As shown in FIGS. 8(F), 8(G), and 8(H), then, the winding 42 is bent by the predetermined projection 48*b* among the plurality of projections 48*b* which are axially arranged in the circumferential position where the winding terminal connecting portion 45*c* of the upper terminal 45 is located in the winding barrel 48, the terminal of the winding 42 is drawn out in the axial direction and toward the upper terminal side that is opposite to the winding start, the terminal of the winding 42 is connected and fixed to the winding terminal connecting portion 45*c* of the upper terminal 45 by soldering, welding, or the like, and an excess portion is cut away. When the projection 48*b* by which the winding 42 is to be bent is selectively changed, it is possible to increase or decrease in units of 1 turn the number of turns of the winding 42 which is wound around the winding barrel 48. As a result, the coil element 40 is completed. The coil element 40 is installed into the antenna case 1 in following manner. First, the upper terminal 45 is fixed together with the capacitive element 10 to the threaded-hole equipped boss 1*b* of the antenna case 1 by the screw 101. Then, the connection leg 47*b* of the lower terminal 47, and the conductor plate springs 51 of the amplifier board 50 are positioned relative to each other, and an assembly of the amplifier board 50, the metal-made base 60, and the resin-made base 70 is attached to the antenna case 1 by, for example, screwing.

Figure 10:
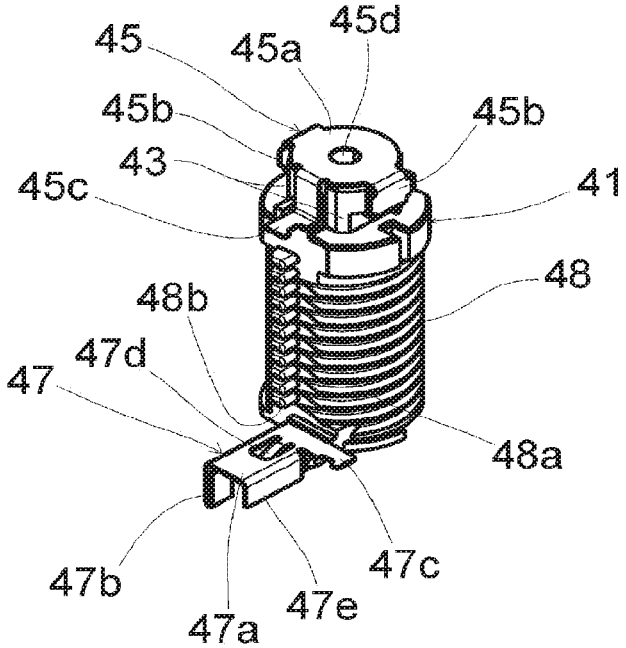
FIG. 10 is a perspective view of an assembled state of the bobbin 41, the upper terminal 45, and the lower terminal 47 of FIG. 9.
Figure 11A:
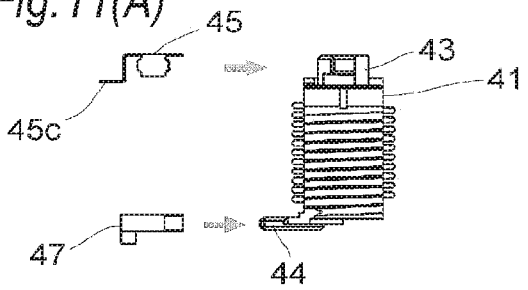
FIGS. 11(A) to 11(H) are views illustrating steps of producing the coil element 40 in the case where the upper terminal 45 is inverted by 180 degrees as compared with FIGS. 8(A) to 8(H).
Figure 11B:
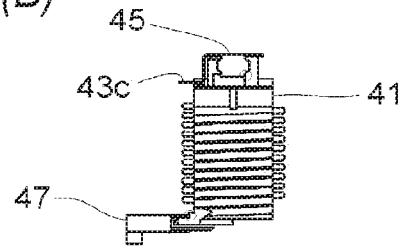
Figure 11C:
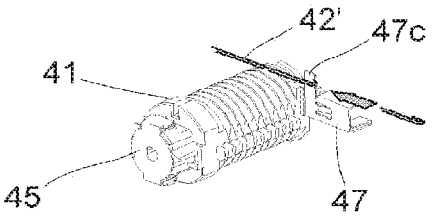
Figure 11D:
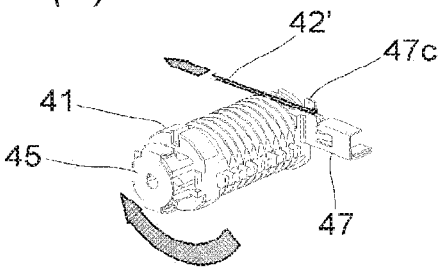
Figure 11E:
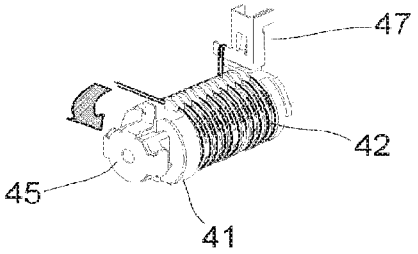
Figure 11F:
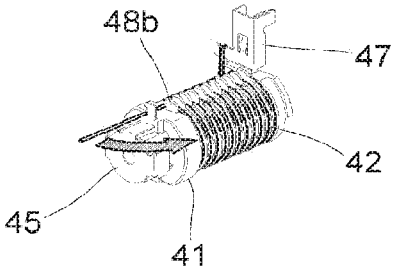
Figure 11G:
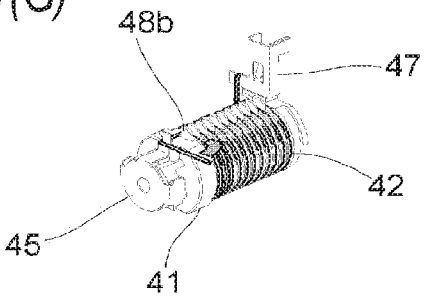
Figure 11H:
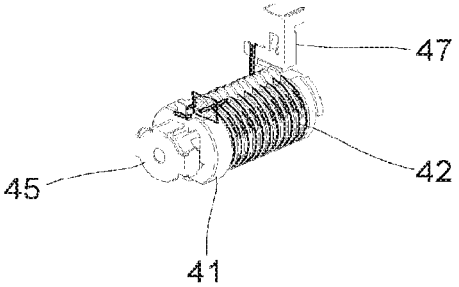

FIG. 9 is a perspective view of a disassembled state of the bobbin 41, the upper terminal 45, and the lower terminal 47 in the case where the upper terminal 45 is inverted by 180 degrees as compared with FIG. 6. FIG. 10 is a perspective view of an assembled state of the bobbin 41, the upper terminal 45, and the lower terminal 47 in FIG. 9. FIGS. 11(A) to 11(H) are views illustrating steps of producing the coil element 40 in the case where the upper terminal 45 is inverted by 180 degrees as compared with FIGS. 8(A) to 8(H). As shown in these figures, the attaching position of the upper terminal 45 to the upper terminal attaching portions 43 of the bobbin 41 may be set to the second circumferential position which is inverted by 180 degrees. The upper terminal 45 can be attached to the second circumferential position in the following manner. As shown in FIG. 9, the upper terminal 45 is placed so that the winding terminal connecting portion 45*c* is directed in the direction opposite to the gap between the pair of convex portions 43*a* of the upper terminal attaching portions 43, and then skid toward the upper terminal attaching portions 43 to cause the pair of attaching legs 45*b* of the upper terminal 45 to be engaged with the pair of convex portions 43*a* of the upper terminal attaching portions 43. Then, the moving-direction end portions of the pair of attaching legs 45*b* of the upper terminal 45 butt against the stoppers 43*b* which are below the pair of convex portions 43*a* of the upper terminal attaching portions 43 to stop the sliding operation, and the attachment of the upper terminal 45 to the upper terminal attaching portions 43 is completed (FIG. 10). As a result, the circumferential position of the winding terminal connecting portion 45*c* of the upper terminal 45 is changed by 180 degrees. That is, there are two modes of attaching the upper terminal 45 to the bobbin 41, and the winding terminal connecting portion 45*c* can be selectively located in one of the two circumferential positions. When the upper terminal 45 is inverted by 180 degrees, the number of turns of the winding 42 is, for example, 9.5 turns or 10.5 turns, and increased or decreased by 0.5 turn as compared with the case of FIGS. 8(A) to 8(H) (for example, 9 turns or 10 turns). In the embodiment, namely, the projection 48*b* on which the winding end portion of the winding 42 is to be hooked is changed, and, as required, the upper terminal 45 is inverted by 180 degrees, whereby the number of turns of the winding 42 can be changed in units of 0.5 turn.

According to the embodiment, it is possible to attain the following effects.

(1) Since the coil element 40 is configured by forming the winding 42 on the bobbin 41, the coil element can be stably held while its winding shape is maintained, as compared with an air-core coil.

(2) The plurality of projections 48*b* which are along the path of the winding 42 are disposed on the outer circumferential surface of the winding barrel 48 of the bobbin 41. Unlike a conventional coil element in which a winding is integrally molded with a resin, when the projection 48*b* on which the winding end portion of the winding 42 is to be hooked is arbitrarily selected during a production process, therefore, the number of turns of the winding 42 can be easily adjusted to comply with a requirement such as different frequencies due to different destination countries. Furthermore, since the projections 48*b* are disposed in a plurality of circumferential positions, the number of turns of the winding 42 can be adjusted in units of smaller than 1 turn, and therefore fine adjustment is enabled.

(3) The coil element 40 is configured by forming the winding 42 on the bobbin 41, and, during a production process, the number of turns of the winding 42 can be easily adjusted as described above. Unlike the case where a winding is integrally molded with an element holder, even when the shape of the element holder 20 is changed because of a change of the design of the antenna, therefore, the bobbin 41, the upper terminal 45, and the lower terminal 47 are commonly used, and the performance of the antenna can be checked or adjusted without waiting for production of molds for the element holder 20. Consequently, products and new models of different designs can be easily developed.

Embodiment 2

Figure 12:
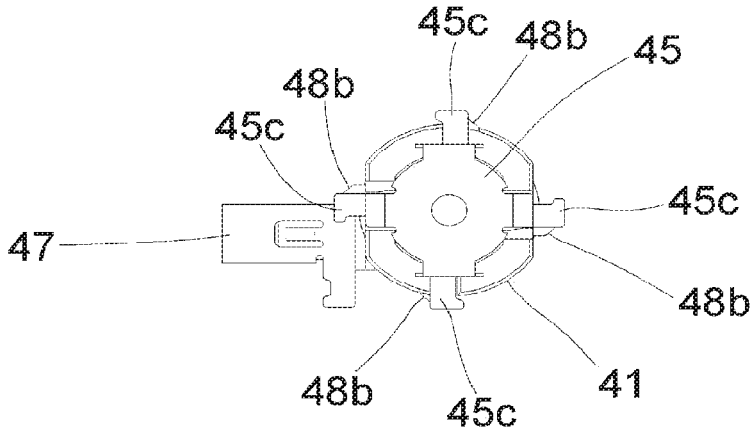
FIG. 12 is a plan view of an assembled state of a bobbin 41, an upper terminal 45, and a lower terminal 47 of a coil element of a vehicle antenna device of Embodiment 2 according to the present invention.
Figure 13:
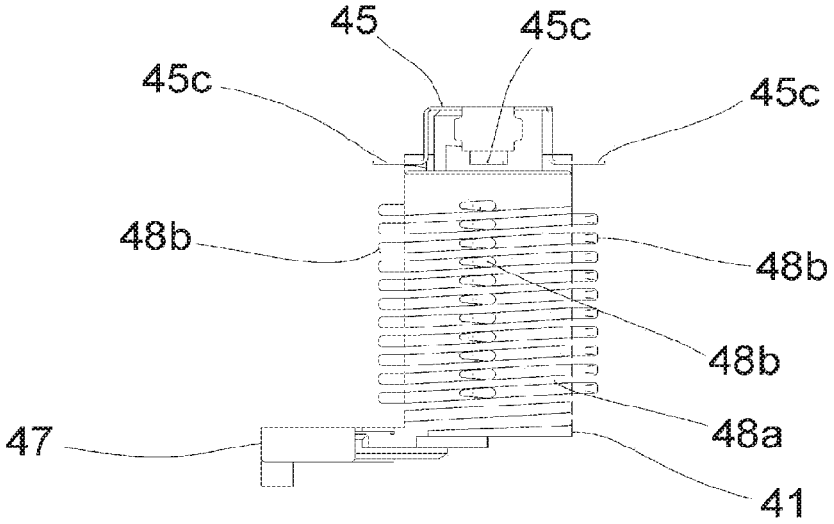
FIG. 13 is a front view of the above.

FIG. 12 is a plan view of an assembled state of a bobbin 41, an upper terminal 45, and a lower terminal 47 of a coil element of a vehicle antenna device of Embodiment 2 of the invention. FIG. 13 is a front view of the above. As compared with Embodiment 1 (FIG. 6 and the like), the embodiment is different in that the projections 48*b* on the outer circumferential surface of the winding barrel 48 of the bobbin 41 are disposed in four circumferential positions (two in Embodiment 1), and that the upper terminal 45 has a plurality (in the illustrated example, four) of winding terminal connecting portions 45*c* corresponding to the circumferential positions of the four projections 48*b*, and identical in the other points. Each of the winding terminal connecting portions 45*c* is in a position where the circumferential position is different by 90 degrees from the adjacent winding terminal connecting portion 45*c*. Namely, the winding terminal connecting portions 45*c* are placed at regular intervals in the circumferential direction. The projections 48*b* which are disposed corresponding respectively to the circumferential positions where the winding terminal connecting portions 45*c* exist are disposed in plural numbers in the axial direction. According to the embodiment, the number of turns of the winding can be changed in units of 0.25 turn without changing the position of attaching the upper terminal 45 to the bobbin 41.

Although the present invention has been described with reference to the embodiments, it is obvious to those skilled in the art that the components and processing processes in the embodiments can be variously modified within the scope of the claims. Hereinafter, modifications will be described.

In the case where the number of turns of the coil element 40 can be adjusted in units of 1 turn, the projections 48*b* may be disposed only in a single circumferential position. The winding of the coil element 40 may be started from the side of the upper terminal 45. The lower terminal may be attached to the bobbin 41 while the attaching position is inverted by 180 degrees, or a plurality of winding terminal connecting portions may be disposed on the lower terminal. In the configuration of Embodiment 1, when the upper terminal 45 is configured so as to be able to be attached while being rotated by 90 degrees, and a plurality of projections 48*b* are disposed in each of the circumferential positions where the winding terminal connecting portions 45*c* can exist, the adjustment can be performed in units of 0.25 turn.

REFERENCE SIGNS LIST

1 antenna case, 1*a* rib, 1*b*, 1*c* threaded-hole equipped boss, 3 pad, 5 sealing member, 10 capacitive element, 11 curved surface portion, 12 connecting portion, 13, 14 through hole, 20 element holder, 21 base portion, 22 cylindrical portion, 22*a* projection, 23 through hole, 40 coil element, 41 bobbin, 42 winding, 42' wire, 43 upper terminal attaching portion, 43*a* convex portion, 43*b* stopper, 44 lower terminal attaching portion, 45 upper terminal (first terminal), 45*a* base portion, 45*b* attaching leg, 45*c* winding terminal connecting portion (tab), 45*d* through hole, 47 lower terminal (second terminal), 47*a* upper surface portion, 47*b* connection leg, 47*c* winding terminal connecting portion (tab), 47*d* plate spring portion, 47*e* side surface portion, 47*f* lower surface portion, 48 winding barrel, 48*a* guide groove, 48*b* projection, 50 amplifier board, 51 conductor plate spring (terminal), 52 output cable, 60 metal-made base (conductive base), 61 planar portion, 62 feeding cylindrical portion (hollow threaded shaft portion), 63 first groove portion, 64 second groove portion, 70 resin-made base (insulative base), 71 planar portion, 72 through hole, 80 provisional fixing holder, 81 clamping portion, 82 liaison portion, 83 engaging claw, 101, 102 screw

The invention claimed is:

1. A vehicle antenna device comprising:
- an antenna base;
- an antenna case which is overlaid on the antenna base; and
- an antenna element and an amplifier board which are disposed inside the antenna case, wherein
- the antenna element has a capacitive element and a coil element,
- the coil element is configured by forming a winding around a bobbin,
- a first terminal is disposed on a side of one end of the bobbin, the first terminal being electrically connected to one end of the coil element, and electrically connected to the amplifier board,
- the first terminal includes a coil connecting portion electrically connected to the coil element,
- the first terminal includes a mode of attachment to the bobbin that is changeable,
- the coil connecting portion of the first terminal is selectively locatable in a plurality of circumferential positions of the bobbin,
- a plurality of projections are disposed on an outer circumferential surface of the bobbin, and along a winding path of the coil element,
- an end portion of the winding of the coil element is drawn out in an axial direction while being hooked on one of the plurality of projections, and
- the winding is bent by the one of the plurality of projections.

2. The vehicle antenna device according to claim 1, wherein the winding and the bobbin are separate elements.

3. The vehicle antenna device according to claim 1, further comprising:
- a second terminal that is disposed on a side of the other end of the bobbin, the second terminal being electrically connected to the other end of the coil element, and electrically connected to the capacitive element.

4. The vehicle antenna device according to claim 1, wherein one or more of the plurality of projections are disposed in each of the plurality of circumferential positions, which are formed on the outer circumferential surface of the bobbin.

5. The vehicle antenna device according to claim 3, wherein, one or more of the plurality of projections are disposed in each of the plurality of circumferential positions, which are formed on the outer circumferential surface of the bobbin,
- the second terminal includes a coil connecting portion electrically connected to the coil element,
- the second terminal includes a mode of attachment to the bobbin that is changeable, and
- the coil connecting portion of the second terminal is selectively locatable in the plurality of circumferential positions.

6. A vehicle antenna device comprising:

an antenna base;

an antenna case which is overlaid on the antenna base; and an antenna element and an amplifier board which are disposed inside the antenna case, wherein the antenna element has a capacitive element and a coil element, the coil element is configured by forming a winding around a bobbin, a terminal is disposed on a side of one end of the bobbin, the terminal being electrically connected to one end of the coil element, and electrically connected to the capacitive element, the terminal includes a coil connecting portion electrically connected to the coil element, the terminal includes a mode of attachment to the bobbin that is changeable, the coil connecting portion of the terminal is selectively locatable in a plurality of circumferential positions, a plurality of projections are disposed on an outer circumferential surface of the bobbin, and along a winding path of the coil element, an end portion of the winding of the coil element is drawn out in an axial direction while being hooked on one of the plurality of projections, and the winding is bent by the one of the plurality of projections.

7. A vehicle antenna device comprising:

an antenna base;

an antenna case which is overlaid on the antenna base; and an antenna element and an amplifier board which are disposed inside the antenna case, wherein the antenna element has a capacitive element and a coil element, the coil element is configured by forming a winding around a bobbin, a plurality of projections are disposed on an outer circumferential surface of the bobbin, and along a winding path of the coil element, a first row of the plurality of projections is arranged in an axial direction of the bobbin at a first circumferential position of the bobbin and a second row of the plurality of projections is arranged in the axial direction of the bobbin at a second circumferential position of the bobbin, which is different from the first circumferential position of the bobbin, an end portion of the winding of the coil element is drawn out in an axial direction while being hooked on one of the plurality of projections, the winding is bent by the one of the plurality of projections, and the number of turns of the winding is adjusted based on different frequencies.

8. The vehicle antenna device according to claim 7, wherein the winding and the bobbin are separate elements.

9. The vehicle antenna device according to claim 7, further comprising:

a first terminal that is disposed on a side of one end of the bobbin, the first terminal being electrically connected to one end of the coil element, and electrically connected to the amplifier board.

10. The vehicle antenna device according to claim 9, further comprising:

a second terminal that is disposed on a side of the other end of the bobbin, the second terminal being electrically connected to the other end of the coil element, and electrically connected to the capacitive element.

11. The vehicle antenna device according to claim 7, wherein one or more of the plurality of projections are disposed in each of the plurality of circumferential positions, which are formed on the outer circumferential surface of the bobbin.

12. The vehicle antenna device according to claim 9, wherein, one or more of the plurality of projections are disposed in each of the first and second circumferential positions, which are formed on the outer circumferential surface of the bobbin, the first terminal includes a coil connecting portion electrically connected to the coil element, the first terminal includes a mode of attachment to the bobbin that is changeable, and the coil connecting portion of the first terminal is selectively locatable in the first and second circumferential positions.

* * * * *